US009370702B1

(12) United States Patent
O'Reilly

(10) Patent No.: US 9,370,702 B1
(45) Date of Patent: Jun. 21, 2016

(54) TRAINING AID FOR SPORTS

(71) Applicant: James O'Reilly, Rockville Centre, NY (US)

(72) Inventor: James O'Reilly, Rockville Centre, NY (US)

( * ) Notice: Subject to any disclaimer, the term of this patent is extended or adjusted under 35 U.S.C. 154(b) by 81 days.

(21) Appl. No.: 14/026,336

(22) Filed: Sep. 13, 2013

Related U.S. Application Data

(60) Provisional application No. 61/700,963, filed on Sep. 14, 2012.

(51) Int. Cl.

| | |
|---|---|
| ***A63B 69/00*** | (2006.01) |
| ***A63B 67/00*** | (2006.01) |
| *A63B 69/38* | (2006.01) |
| *A63B 47/00* | (2006.01) |
| *A63B 63/00* | (2006.01) |

(52) U.S. Cl.
CPC ..... *A63B 69/00* (2013.01); *A63B 47/002* (2013.01); *A63B 63/00* (2013.01); *A63B 63/004* (2013.01); *A63B 69/0002* (2013.01); *A63B 69/0026* (2013.01); *A63B 69/38* (2013.01); *A63B 2069/0008* (2013.01)

(58) Field of Classification Search
CPC ..... A63B 69/3644; A63B 69/3641; A63B 69/3647; A63B 21/023; A63B 21/04; A63B 21/0552; A63B 21/06; A63B 15/005; A63B 69/0057; A63B 15/00; A63B 69/38; A63B 21/00185; A63B 2069/0008; A63B 69/0002
USPC ..... 473/422, 450, 458, 464, 451, 438, 457, 473/219, 226, 229; D21/694, 756–767, D21/780; 482/148, 83–86
See application file for complete search history.

(56) References Cited

U.S. PATENT DOCUMENTS

| | | | | | |
|---|---|---|---|---|---|
| 1,137,349 | A | * | 4/1915 | Patterson | 473/203 |
| 1,932,099 | A | * | 10/1933 | Cabana | A47L 13/252 15/143.1 |
| 2,134,451 | A | * | 10/1938 | Mogren | 473/457 |
| 2,455,707 | A | | 12/1948 | Sheffer | |
| 2,788,214 | A | * | 4/1957 | Tilden | A63B 69/3647 473/229 |
| 2,848,234 | A | * | 8/1958 | Brandon | A63B 69/3647 473/204 |
| 3,462,156 | A | * | 8/1969 | Gentry | A63B 21/153 473/229 |
| 3,618,942 | A | | 11/1971 | Bates | |
| 3,704,479 | A | * | 12/1972 | Whitaker | B25G 3/38 15/172 |
| 3,966,203 | A | | 6/1976 | Bickford | |
| 4,225,133 | A | * | 9/1980 | Kiray | 473/457 |
| 4,229,002 | A | * | 10/1980 | Masters | A63B 21/06 473/229 |
| 4,243,219 | A | * | 1/1981 | Price | 473/457 |
| 4,328,964 | A | * | 5/1982 | Walls | 473/229 |
| 4,600,190 | A | * | 7/1986 | Berokoff | 473/457 |
| 4,749,189 | A | * | 6/1988 | Frank | 482/129 |
| 4,944,518 | A | * | 7/1990 | Flynn | 473/229 |
| 5,082,262 | A | * | 1/1992 | Sanchez | 473/458 |
| 5,158,299 | A | | 10/1992 | Otter | |
| 5,269,512 | A | * | 12/1993 | Crowson et al. | 473/457 |
| 5,423,730 | A | * | 6/1995 | Hirsch | 482/92 |
| D362,894 | S | * | 10/1995 | Gasperoni, Sr. | D21/791 |
| 5,544,886 | A | * | 8/1996 | VanSkiver | A63B 69/0079 473/143 |
| 5,590,437 | A | * | 1/1997 | McMillin | A46B 3/14 15/143.1 |

(Continued)

*Primary Examiner* — Mitra Aryanpour
(74) *Attorney, Agent, or Firm* — Galgano IP Law PLLC; Thomas M. Galgano; Jessica G. McDonald

(57) ABSTRACT

A sports training aid for attaching a free end of a shaft of an article of athletic equipment to a resistance source, including at least one coupling member having two opposite ends. The first end is coupled to the free end of the shaft of the athletic equipment and the second end is coupled to the resistance source.

18 Claims, 7 Drawing Sheets

(56) References Cited

U.S. PATENT DOCUMENTS

| | | | | |
|---|---|---|---|---|
| 6,022,299 | A * | 2/2000 | Stewart | A63B 21/062 482/102 |
| 6,245,002 | B1 * | 6/2001 | Beliakov | 482/148 |
| 6,413,196 | B1 * | 7/2002 | Crowson | 473/445 |
| 6,503,150 | B1 * | 1/2003 | Holmes | A63B 9/3655 473/219 |
| 6,537,184 | B2 * | 3/2003 | Kim | 473/131 |
| 6,572,497 | B1 * | 6/2003 | Halsworth | 473/453 |
| 6,837,808 | B1 * | 1/2005 | Hatch | A63B 69/0088 473/424 |
| 6,949,035 | B1 | 9/2005 | Halsworth | |
| 7,048,638 | B2 * | 5/2006 | Novotny | A63B 21/04 434/252 |
| 7,074,131 | B1 * | 7/2006 | Renaud | 473/219 |
| D576,231 | S * | 9/2008 | Rasmussen et al. | D21/694 |
| 7,677,992 | B2 * | 3/2010 | Moos | 473/453 |
| 7,762,913 | B1 * | 7/2010 | Hagen et al. | 473/457 |
| 7,892,103 | B2 | 2/2011 | Vahary | |
| 7,914,390 | B2 * | 3/2011 | Seiter et al. | 473/257 |
| 8,192,335 | B2 | 6/2012 | Pullaro | |
| 8,251,877 | B2 * | 8/2012 | Rasmussen et al. | 482/100 |
| 8,282,500 | B1 | 10/2012 | Masching | |
| 8,556,755 | B1 * | 10/2013 | Zackery | 473/453 |
| 2007/0111867 | A1 * | 5/2007 | Pullaro | A63B 15/00 482/121 |
| 2009/0305826 | A1 * | 12/2009 | Patenaude et al. | 473/457 |
| 2010/0035706 | A1 * | 2/2010 | Sanchez | 473/453 |
| 2011/0111889 | A1 * | 5/2011 | Smyrnios | 473/437 |
| 2011/0212797 | A1 * | 9/2011 | Adkins | 473/451 |
| 2011/0237359 | A1 * | 9/2011 | Purl | 473/453 |
| 2012/0035004 | A1 * | 2/2012 | Flores | 473/457 |
| 2013/0296081 | A1 * | 11/2013 | Auzoux | 473/463 |

* cited by examiner

TRAINING AID FOR SPORTS

CROSS-REFERENCE TO RELATED APPLICATION

This application claims benefit from U.S. Provisional Patent Application Ser. No. 61/700,963, filed Sep. 14, 2012, the contents of which are hereby incorporated by reference.

BACKGROUND OF THE INVENTION

1. Field of the Invention

The invention is generally in the field of sporting or athletic training equipment. More particularly, the invention relates to training equipment for sports with sticks, rackets or bats. Most particularly, the invention is especially adapted for use as a training aid in connection with a shaft of a lacrosse stick.

2. Brief Description of the Prior Art

Lacrosse is a sport that is most popular in North America and was the first team sport in America, dating back to the 17th century. It is also currently the fastest growing sport in the United States. The number of players on the field depends on the league, particularly, ten players for men's field; six players for men's box or twelve players for women's field.

All three types of lacrosse use a conventional lacrosse stick 100, as seen best in FIG. 1, comprising a netted plastic head 104 which is about 12 inches long and 7 inches wide at the top, narrowing down to about 4 inches at the bottom, which is affixed atop a free end 22 of a shaft 20 having a polygonal latitudinal cross-section. The object of the lacrosse game is to pass around a solid rubber ball, that is about 2¼ inches in diameter, from player to player until one player has an opening or an opportunity to aim and shoot the ball toward the goal. Each goal is worth a point. The harder and faster the shot, the better the chances of scoring. Thus, increasing shooting and passing speed is the goal of every player. Similarly, it is the aim of the goalie to increase the speed of their catching motions, to enable them to better prevent the ball from entering the goal.

It is therefore, advantageous, to provide a training aid which can help a player improve their skills and particularly, for example, their shooting, passing and/or catching speeds.

SUMMARY OF THE INVENTION

Accordingly, it is an object of the present invention to provide a novel sports training aid.

It is also an object of the present invention to provide a sports training aid which can be attached to the free end of an article of athletic equipment having a shaft.

It is a further object of the present invention to provide a sports training aid which can be attached to a resistance source such as, a conventional cable and pulley weight lifting machine or an elastic resistance band.

It is another object of the present invention to provide a sports training aid which is simple and easy to use.

Furthermore, it is an object of the present invention to provide a sports training aid which can be attached to a shaft of a lacrosse stick with the netted head removed.

It is another object of the present invention to provide a sports training aid which can assist a user in increasing the speed of their shooting, passing, and/or catching motions.

Certain of the foregoing and related objects are attained according to the present invention by the provision of a sports training aid, comprising means for attaching a free end of a shaft of an article of athletic equipment to a resistance source, said means for attaching comprising at least one coupling member having two opposite ends, a first end coupled to said free end of said shaft of said athletic equipment and a second end coupled to said resistance source.

Preferably, said coupling member is releasably coupled to said free end of said shaft of said athletic equipment. Also preferred is that said coupling member is releasably coupled to said resistance source. In one embodiment, said sports training aid is made of plastic. In another embodiment, said sports training aid is made of aluminum.

Advantageously, said article of athletic equipment is a shaft of a lacrosse stick without a netted head.

Preferably, said second end of said coupling member comprises an eyelet extending outwardly therefrom, for coupling said coupling member to said resistance source. Also preferred is that said first end of said coupling member comprises an outwardly-opening bore, for receipt of said free end of said shaft of said athletic equipment therein. Desirably, said bore has a generally rectangular cross-section.

Furthermore, it is desirable that said at least one coupling member comprises a first coupling member which is connected to said resistance source and a second coupling member which is connected to said free end of said shaft of said athletic equipment, and wherein said first coupling member and said second coupling member are rotationally connected to each other in a manner which permits said first and second coupling members to rotate 360° relative to each other about an axis of rotation. Preferably, one of said first and said second coupling members has a generally cylindrically-shaped male end portion and the other of said first and said second coupling members has an open-ended, generally cylindrically-shaped bore defined therein, which is configured and dimensioned for receipt of said male end portion therein.

Advantageously, said first and said second coupling members each have coaxially extending longitudinal axes and wherein said axis of rotation is coaxially aligned with said longitudinal axes of said first and said second coupling members. Preferably, said coupling member has a screw hole defined therein, generally adjacent said first end thereof and a screw hole is defined in said shaft of said athletic equipment generally adjacent said free end, and wherein said screw extends through said screw hole in said coupling member and said screw hole in said shaft of said athletic equipment.

It is also desirable that said resistance source comprises a cable having two opposite ends, wherein one end of said cable is connected to said second end of said coupling member and said other end of said cable is connectable to at least one moveable weight. Alternatively, said resistance source comprises an elastic resistance band having two opposite ends, wherein one end of said resistance band is connected to said second end of said coupling member and said other end of said cable is connectable to a stationary object.

Furthermore, certain of the foregoing and related objects are attained according to the present invention by the provision of a sports training aid kit, comprising an article of athletic equipment having a shaft with a free end; and a sports training aid comprising means for attaching said free end of said shaft of said article of athletic equipment to a resistance source, said means for attaching comprising at least one coupling member having two opposite ends, a first end coupled to said free end of said shaft of said athletic equipment and a second end coupled to said resistance source. Preferably, said article of athletic equipment is a shaft of a lacrosse stick without a netted head. Advantageously, a resistance source is coupled to said second end of said coupling member. Desirably, said resistance source comprises a cable having two opposite ends, wherein one end of said cable is connected to said second end of said coupling member and said other end of said cable is connectable to at least one moveable weight. Alternatively, said resistance source comprises an elastic resistance band having two opposite ends, wherein one end of said resistance band is connected to said second end of said coupling member and said other end of said cable is connectable to a stationary object.

Additionally, certain of the foregoing and related objects are attained according to the present invention by the provision of a method for training for playing sports utilizing an article of athletic equipment having a shaft with a free end and means for attaching the free end of the shaft of the article of athletic equipment to a resistance source, said means for attaching comprising at least one coupling member having two opposite ends, said first end being coupled to said free end of said shaft of said athletic equipment and said second end being coupled to said resistance source, comprising the steps of, coupling said first end of said coupling member to said free end of said shaft of said athletic equipment; and coupling said second end of said coupling member to said resistance source. Advantageously, the method further comprises the step of repetitively moving said article of athletic equipment in a desired motion at least a portion of which is against a force of resistance provided by said resistance source.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 2:
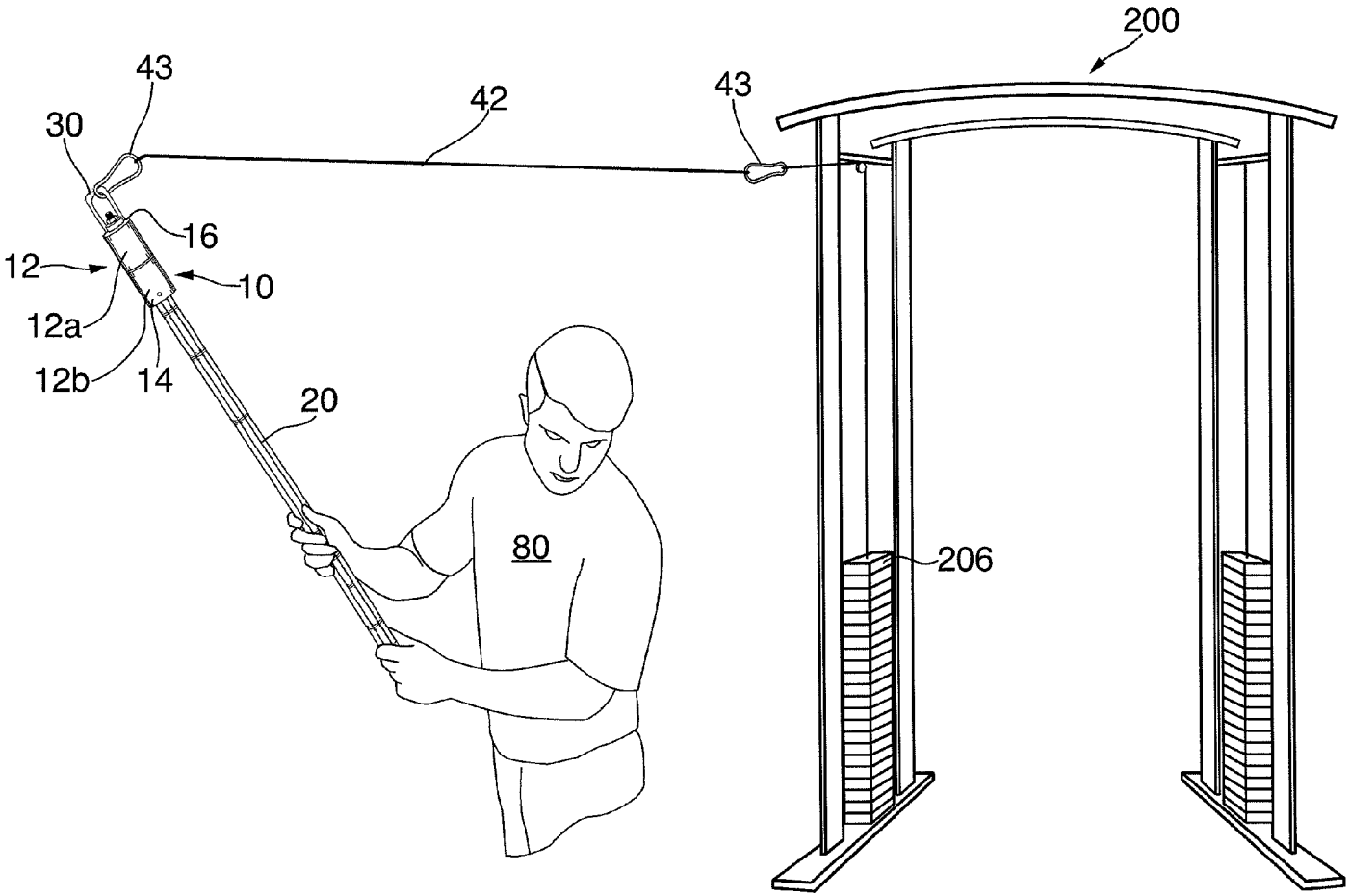
FIG. 2 is a perspective view of a player holding one embodiment of the training aid according to the present invention, which is connected to a conventional cable and pulley weight lifting machine.
Figure 3:
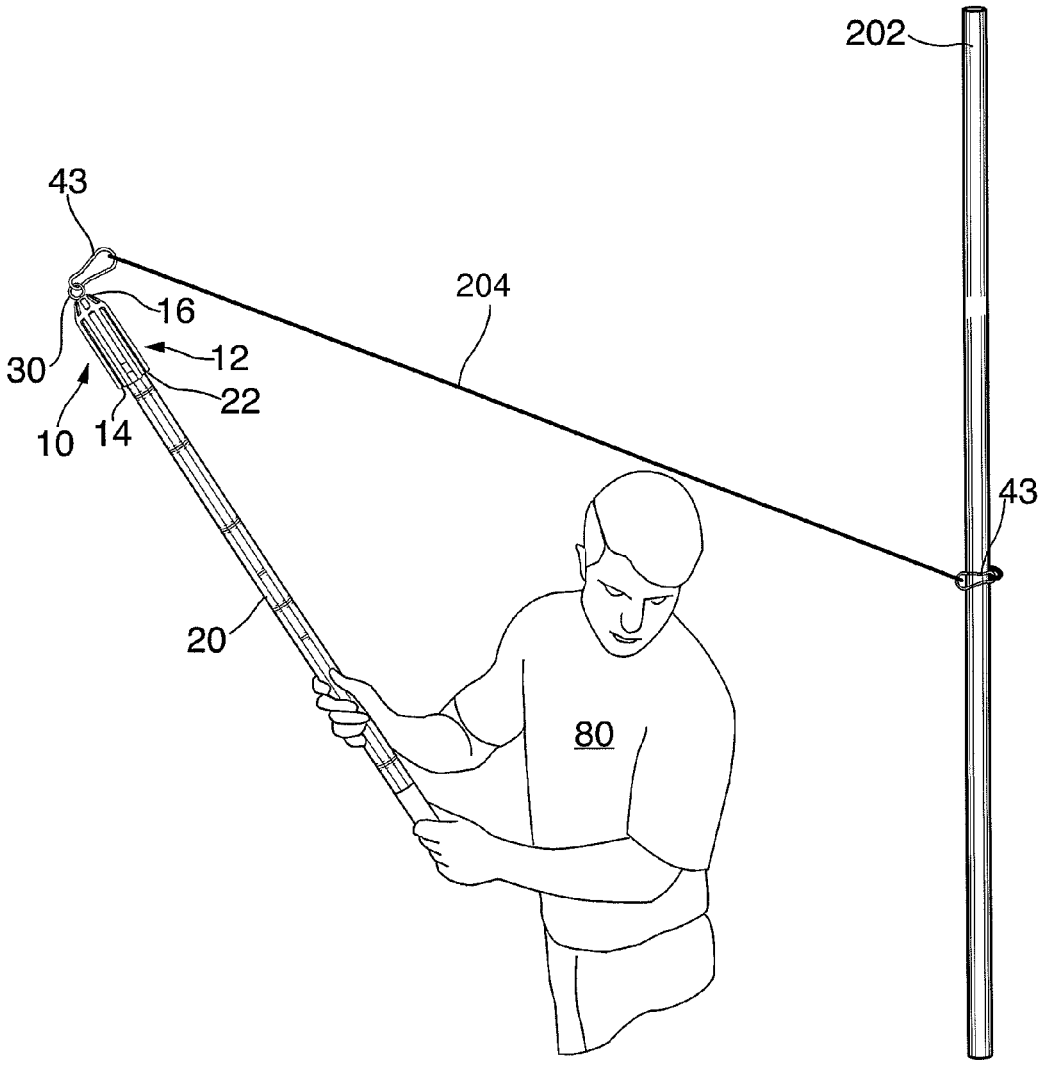
FIG. 3 is a perspective view of a player holding another embodiment of the training aid according to the present invention, which is connected to an elastic resistance band attached to a stationary object.

Turning now to FIGS. 2 and 3, the sports training aid according to the present invention, generally designated by reference numeral 10, is utilized to help train and condition an athlete and, particularly, a lacrosse player 80, by allowing the player 80 to practice their full range of game playing motions with increased resistance. An aim of the training aid 10 is to strengthen and increase the speed of the player's game playing movements, such as shooting, passing, and/or catching motions, by assisting the player 80 to repetitively practice these motions at an increased resistance.

Figure 1:
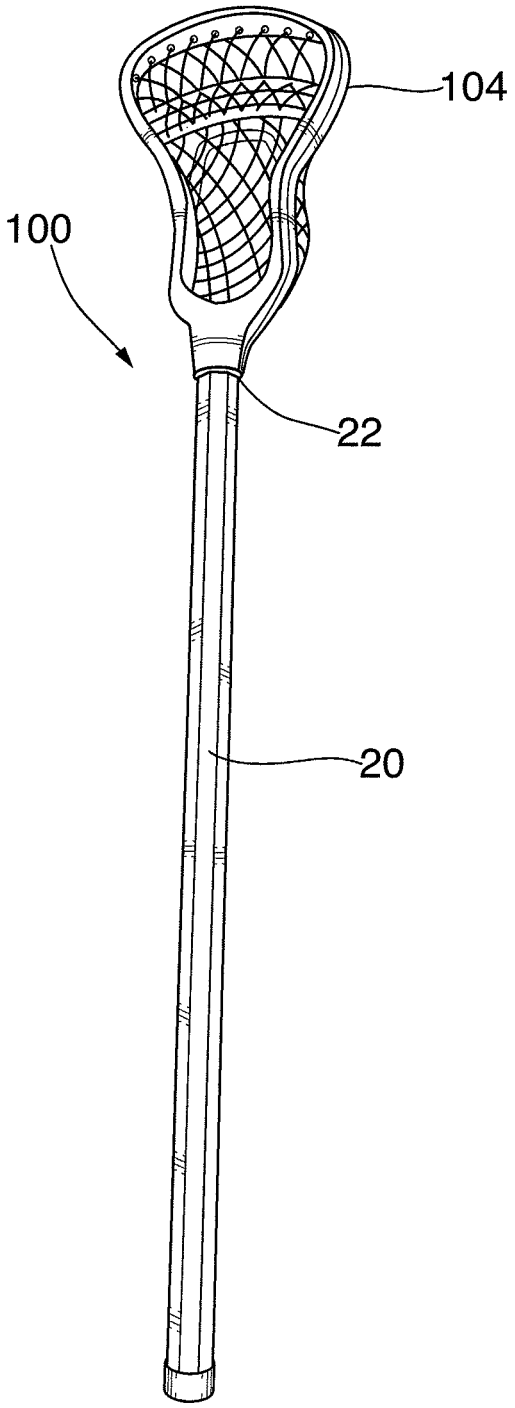
FIG. 1 PRIOR ART
FIG. 1 is a perspective view of a conventional lacrosse stick, according to the prior art.

As seen best in FIGS. 2 and 3, the sports training aid 10 includes at least one coupling member 12 which is affixed to the free, top end 22 of the shaft 20 of an article of athletic equipment. The present invention is particularly suitable for use in connection with a conventional lacrosse stick 100 as shown in FIG. 1, with the netted head 104 removed from the shaft 20. In use, as seen in FIGS. 2 and 3, coupling member 12 is attached to the free end 22 of the shaft 20 of the lacrosse stick 100 in place of the netted head 104. However, the present invention can be used or modified to be used with any type of athletic equipment, such as, for example, any sport utilizing a stick, club, racket or bat.

Coupling member 12 and, in turn, shaft 20 are connected to a resistance source which provides resistance against the player's force, such as, for example, a conventional stationary cable and pulley weight lifting machine 200, as shown in FIG. 2 or a conventional elastic resistance band 204 attached to a stationary object 202, as shown in FIG. 3. A player 80 can utilize the training aid 10 by repetitively moving the shaft 20 of the lacrosse stick 100 in a desired motion, such as, for example, the full range of shooting, passing and/or catching motions, at least a portion of which is against the force of resistance provided by the resistance source, in order to train and condition the various muscles utilized in the movements.

More particularly, as seen best in FIGS. 2 and 3 coupling member 12 has a first end 14 and an opposite second end 16. The first end 14 of the coupling member 12 is affixed to the free end 22 of the shaft 20 of the lacrosse stick 100, once the netted head 104 has been removed. It is preferable that the coupling member 12 be releasably affixed to free end 22 of shaft 20 of lacrosse stick 100. This allows a player 80 to utilize the shaft 20 of their own lacrosse stick 100 as part of the training aid 10 or vary which shafts 20 are utilized. Furthermore, this permits different lacrosse sticks 100 to be utilized with the same training aid 10 and, therefore, multiple players can utilize the training aid 10 by attaching their desired shaft 20 to coupling member 12. However, it can be appreciated that the coupling member 12 and shaft 20 can be permanently connected together or formed as a single component.

Figure 4:
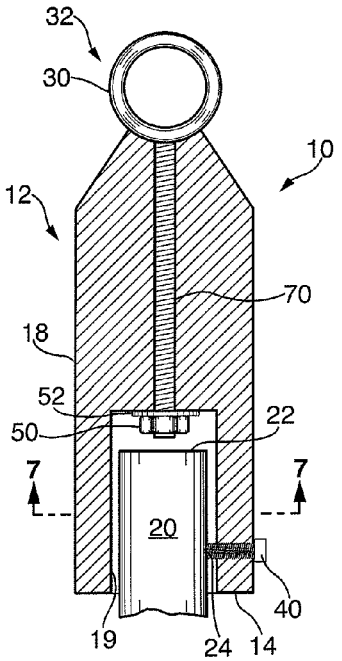
FIG. 4 is a sectional view, in part elevation, of the first embodiment of the training aid according to the present invention, having a single coupling member and showing it mounted on a free end of the shaft of a lacrosse stick.
Figure 5A:
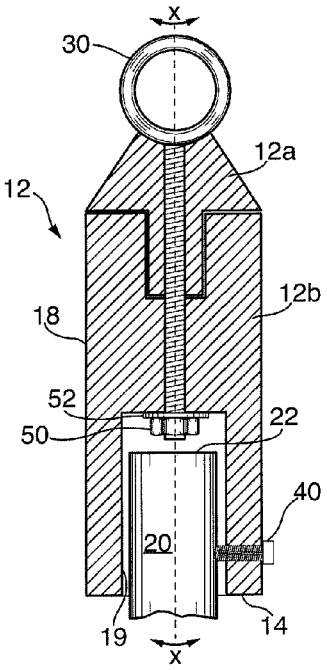
FIG. 5*a* is a sectional view, in part elevation, of the second embodiment of the training aid according to the present invention, having a two-piece coupling member and showing it mounted on the free end of the shaft of a lacrosse stick.
Figure 5B:
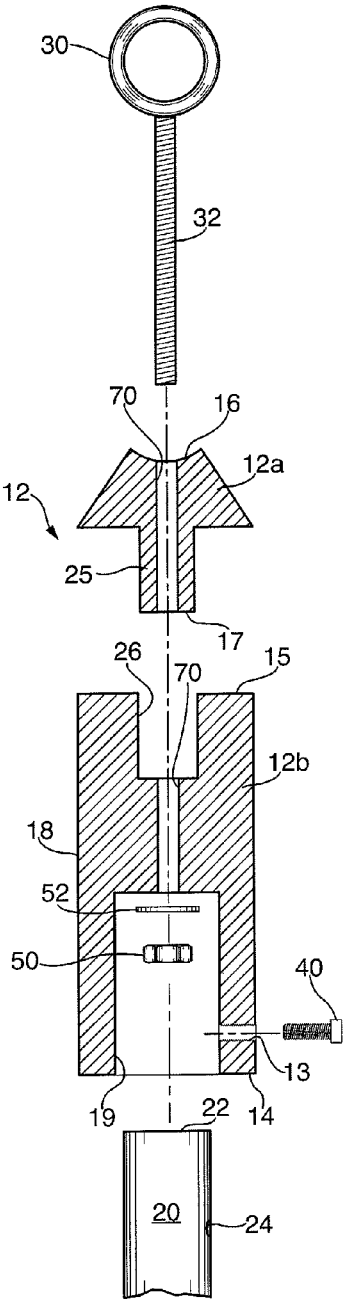
FIG. 5*b* is an exploded, sectional view, in part elevation of the second embodiment of the present invention, illustrated in FIG. 5*a;*

Conventional lacrosse sticks 100 include a screw hole 24 which is formed in the lateral sidewall of shaft 20 generally adjacent free end 22, as seen best in FIG. 5*b*. Typically, screw hole 24 is utilized in combination with a self-tapping screw 40 in order to connect the netted head 104 to the shaft 20. As seen best in FIG. 5*b*, the coupling member 12 also includes a screw hole 13 formed in lateral sidewall 18, generally adjacent end 14. Coupling member 12 is secured to shaft 20 by aligning screw hole 24 on shaft 20 with screw hole 13 on coupling member 12 and inserting self-tapping screw 40 therein, as illustrated in FIGS. 4-6*b*. However, it can be appreciated that other means for connecting the coupling member 12 to the free end 22 of shaft 20 can be utilized, such as by corresponding screw threads on screw 40 and screw holes 24 and 13.

As seen in FIGS. 2 and 3, the second end 16 of the coupling member 12 is attached to a source of resistance via a closed loop or eyelet 30 at least partially extending outwardly therefrom. The source of resistance is, for example, a conventional stationary pulley and cable weight lifting machine 200, as seen in FIG. 2. As an alternative to attaching training aid 10 to a weight lifting machine 200, training aid 10 can be attached to a stable stationary object 202, such as a pole, tree, fence, goal post, etc., via a resistance band 204, as seen in FIG. 3. However, other suitable resistance sources can be utilized. It is preferable that coupling member 12 is releasably coupled to the resistance source, to allow training aid 10 to be disconnected.

Figure 7:
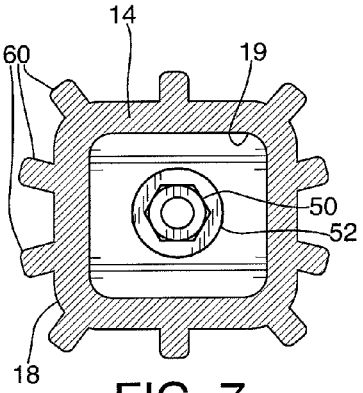
FIG. 7 is a sectional view taken along line 7-7 in FIG. 4.

Furthermore, as seen in FIGS. 4-6*b*, coupling member 12 has a generally tubular sidewall 18 defining an outwardly-opening bore or chamber 19 therebetween on first end 14, for receipt of shaft 20 therein. As seen in FIGS. 2 and 8-10, sidewall 18 may be generally cylindrically-shaped. Alternatively, as seen in FIG. 7, sidewall 18 may be generally rectangularly-shaped. However, any suitable shape can be utilized for sidewall 18, so long as shaft 20 can be received therebetween. Furthermore, as shown best in FIGS. 7 and 8, sidewall 18 may be formed with outwardly projecting ribs 60, to increase the strength of coupling member 12.

As illustrated in FIGS. 4-6*b*, bore 19 is configured and dimensioned for receipt of free end 22 of shaft 20 of lacrosse stick 100 therein, to allow coupling member 12 to be affixed to shaft 20. Preferably, as seen best in FIGS. 7 and 10, bore 19 has a generally rectangular latitudinal cross-section, to correspond to the shape of lacrosse shaft 20 and accommodate the free end 22 of the shaft 20 therein. Since the dimensions of the shafts 20 of male and female lacrosse sticks differ, the bore 19 can be modified to have a size and/or a shape to correspond to the size and/or shape of the shaft 20 of the lacrosse stick 100 it is being used in conjunction with. Furthermore, bore 19 can be modified to accommodate different articles of athletic equipment, such as, for example, any athletic equipment utilizing a stick, club, racket or bat.

Additionally, as seen in FIGS. 2 and 3 in order to connect the coupling member 12 to a source of resistance, coupling member 12 includes an eyelet 30 which extends outwardly from second end 16 of coupling member 12. As seen in FIGS. 3-5*b*, eyelet 30 is the top loop-shaped portion of a conventional eyebolt 32. Alternatively, as seen in FIGS. 2, 6*a*, 6*b* and 9, eyelet 30 is a generally U-shaped loop or arch projecting outwardly from second end 16 of coupling member 12. However, it can be appreciated that other suitable shapes of eyelet 30 or alternative means to connect coupling member 12 to a resistance source, can be utilized.

In certain embodiments of the present invention, as illustrated in FIGS. 2, 5*a*, 5*b*, 6*b*, 8 and 9, coupling member 12 comprises a first coupling member 12*a* which is connected to the resistance source and a second coupling member 12*b* which is connected to the free end 22 of the shaft 20 of the lacrosse stick 100. In the embodiments where the coupling member has two-pieces, 12*a* and 12*b*, the first coupling member 12*a* and the second coupling member 12*b* are rotationally connected to each other in a manner which permits them to rotate 360° relative to each other about an axis of rotation x, to provide the player 80 with a full range of motion.

Figure 6A:
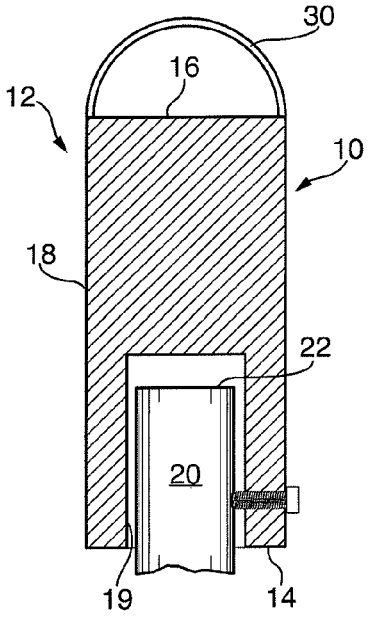
FIG. 6*a* is a sectional view, in part elevation, of the third embodiment of the training aid according to the present invention, having a single coupling member and showing it mounted on the free end of the shaft of the lacrosse stick.
Figure 6B:
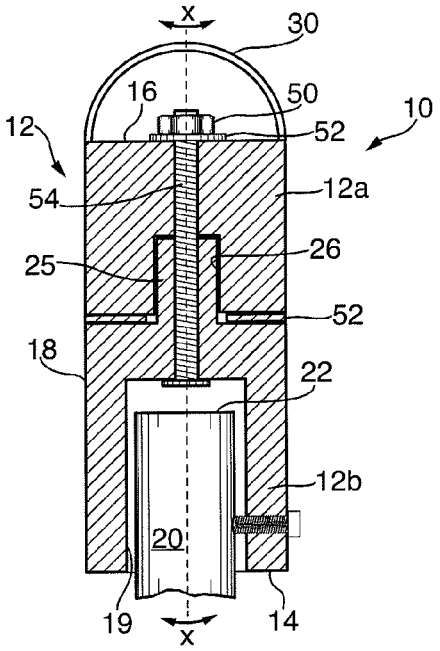
FIG. 6*b* is a sectional view, in part elevation, of the fourth embodiment of the training aid according to the present invention, having a two-piece coupling member and showing it mounted on the free end of the shaft of the lacrosse stick.
Figure 8:
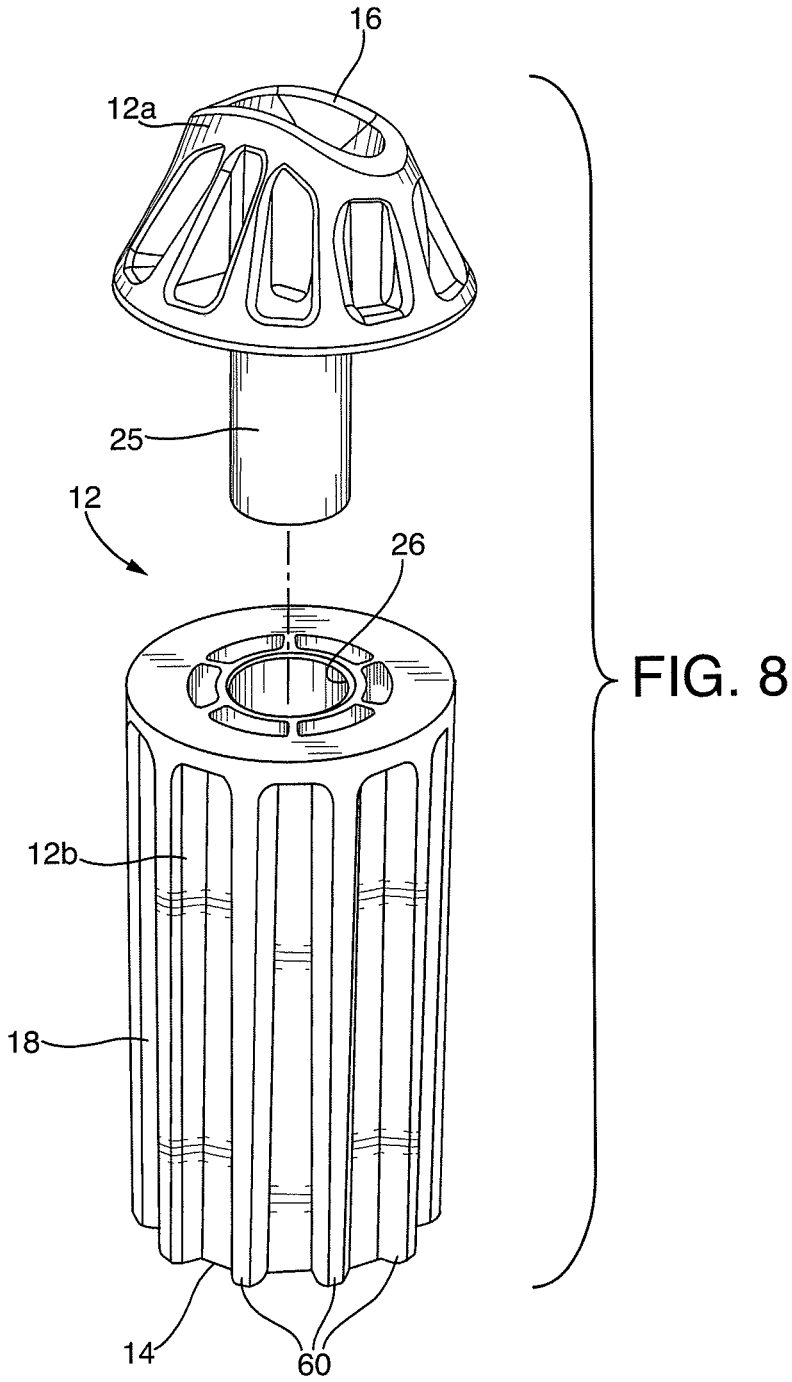
FIG. 8 is an exploded perspective view of the coupling members of the second embodiment of the present invention, illustrated in FIG. 5*b*.
Figure 9:
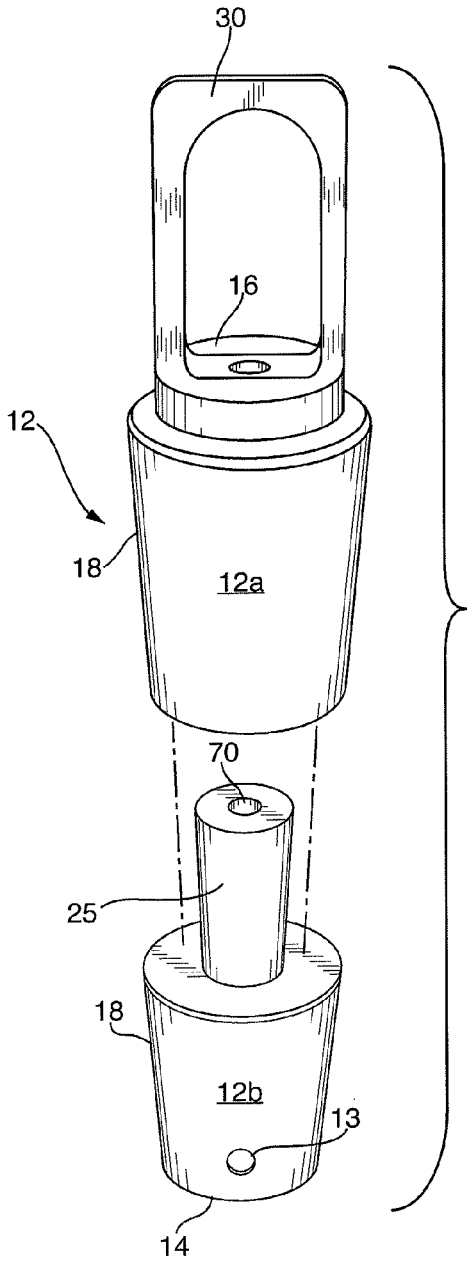
FIG. 9 is an exploded perspective view of the coupling members of the fourth embodiment of the present invention, illustrated in FIG. 6*b*.
Figure 10:
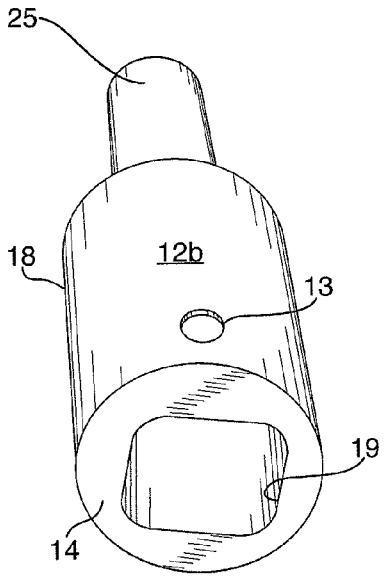
FIG. 10 is a perspective view of the first end of one of the coupling members of the fourth embodiment of the present invention, illustrated in FIG. 9.

More particularly, in the embodiments illustrated in FIGS. 5*b* and 6*b*, coupling member 12*b* has a first end 14 and an opposite second end 15 and coupling member 12*a* has a first end 17 and an opposite second end 16. Coupling members 12*a* and 12*b* each have coaxially extending longitudinal axes. As illustrated in FIGS. 5*a* and 6*b*, the axis of rotation x is coaxially aligned with the longitudinal axes of first and second coupling members 12*a* and 12*b* and axis x extends through the center of first and second coupling members 12*a* and 12*b* from first end 14 of coupling member 12*b* to second end 16 of coupling member 12*a*, to permit 360° rotation about axis x. In use with shaft 20, coupling member 12*b* is affixed to shaft 20 of the lacrosse stick 100, to prevent movement of coupling member 12*b* relative to the shaft. Coupling member 12*a* is able to rotate 360° relative to coupling member 12*b* and, in turn, shaft 20 and vice versa, about axis x.

Furthermore, first coupling member 12*a* and second coupling member 12*b* have corresponding male and female end portions 25 and 26, which allows them to be rotationally connected together. In the embodiment illustrated in FIGS. 5*a*, 5*b* and 8, first coupling member 12*a* includes a male end portion 25 and second coupling member 12*b* includes a female end portion 26. In the embodiment illustrated in FIGS. 2, 6*b*, and 9-10, coupling member 12*b* includes male end portion 25 and coupling member 12*a* includes female end portion 26. Male end portion 25 is generally cylindrically-shaped, recessed, and outwardly projecting from a head portion having a lower surface having an outer peripheral edge. Female end portion 26 has an upper surface having an outer peripheral edge and a generally cylindrically-shaped open ended female bore defined in sidewall 18 which is spaced inwardly from the outer peripheral edge thereof and is configured and dimensioned for rotational receipt of male end portion 25 therein. Once male end portion 25 is received within female end portion 26, the first and second coupling members 12*a* and 12*b*, are able to rotate 360° relative to each other about a longitudinally extending axis of rotation x with the lower surface of the head portion abutting the upper surface of the female end portion 26, and preferably with the outer peripheral edges of the lower surface of the head portion and upper surface of the female end portion 26 in alignment. This rotation allows the user to have a full 360° range of motion when practicing his or her shooting, passing and/or catching motions. However, it can be appreciated that other means to rotationally connect coupling members 12*a* and 12*b* together can be utilized.

As shown in FIGS. 4-5*b*, the first and second coupling members 12*a* and 12*b* are joined together via eyebolt 32 which extends through a screw hole 70 formed in the center of the first and second coupling members 12*a* and 12*b* and secured with nut 50 and washer 52 inside chamber 19. As seen in FIG. 6*b*, in another embodiment first and second coupling members 12*a* and 12*b* are joined together via a screw 54, washer 52, and nut 50 which extends through a generally centrally disposed longitudinally extending screw hole 70 formed in first and second coupling members 12*a* and 12*b*. However, other suitable means to rotationally connect coupling members 12*a* and 12*b* together, can be utilized. In the embodiment shown in FIG. 6*b*, the training aid 10 further includes a nylon washer 52 disposed between first coupling member 12*a* and second coupling member 12*b* to ease rotation therebetween.

In other embodiments of the present invention, as illustrated in FIGS. 3, 4 and 6*a*, the coupling member 12 is one piece, without rotational movement. Particularly, as seen in FIGS. 4 and 6*a*, coupling member 12 includes an outwardly opening bore 19 formed on end 14 for receipt of top end 22 of shaft 20 therein, to prevent movement between shaft 20 and coupling member 12. In the embodiment in FIG. 4, eyebolt 30 extends through screw hole 70 and is secured with nut 50 and washer 52 on the inside of bore 19. Eyelet 30 of eyebolt 32 extends outwardly from first end 16 and is utilized to connect coupling member 12 to a resistance source. In the embodiment in FIG. 6*a*, eyelet 30 is a generally U-shaped, loop or arch formed as part of coupling member 12 and which projects outwardly from end 16, to permit connection of coupling member 12 to a resistance source.

The embodiment illustrated in FIGS. 2, 6*b* and 9-10 is similar to that illustrated in FIG. 6*a*, but coupling member 12 is one-piece in FIG. 6*a* and two pieces 12*a*, 12*b* in FIGS. 2, 6*b* and 9-10. Similarly, the embodiment illustrated in FIGS. 3-4 is similar to that in FIGS. 5*a*-5*b* and 8, but coupling member 12 is one piece in FIGS. 3-4 and two pieces 12*a* and 12*b*, in FIGS. 5*a*-5*b* and 8.

Furthermore, the embodiments illustrated in FIGS. 3-5*b* and 7-8 are preferably made of a plastic material except for eyebolt 30 which is preferably made of metal. In the embodiments in FIGS. 2, 6*a*-6*b* and 9-10, the coupling member 12 is made of metal, preferably, aluminum. However, it can be appreciated that other suitable materials can be utilized.

Once shaft 20 is connected to coupling member 12, training aid 10 can be connected to weight lifting machine 200 via a conventional cable 42 having a conventional spring clip 43 on each ends thereof, shown in FIG. 2. However, it can be appreciated that any other means suitable to attach training aid 10 to machine 200, can be utilized. In order to affix training aid 10 to weight lifting machine 200, the lacrosse player 80 would attach the eyelet 30 to cable 42 using one of the spring clips 43, as shown best in FIG. 2. The other end of cable 42 is attached to moveable weights 206 on machine 200, via the other spring clip 43. Once training aid 10 and, in turn, lacrosse shaft 20 are attached to machine 200, the player would set the desired weight on machine 200 and proceed to go though their full range of motions as if they were shooting, passing, or catching the ball. The moveable weights 206 which are in turn connected to training aid 10 provide increased resistance against the force from the player's movements.

Additionally, as seen in FIG. 3, training aid 10 can be connected to other stable stationary objects 202, such as a pole, tree, fence, goal post, etc., via a conventional elastic resistance band 204. Particularly, in order to affix training aid 10 to stationary object 202, the lacrosse player would attach the eyelet 30 to resistance band 204 using one of the spring clips 43, as shown best in FIG. 3. The other end of resistance band 204 is attached to the stationary object 202, via the other spring clip 43. The player 80 can then go though his full range of motions as if he were shooting, passing, and/or catching and resistance band 204 extends and contracts to provide increased resistance against the player's force. Resistance bands 204 come in many different resistances so a user can chose what level of resistance is appropriate.

Although bore 19 is formed to accommodate the shaft 20 which is received therein, alternatively, an adapter (not shown) can be utilized to account for the size difference between chamber 19 and the shaft 20. The adapter can be used to fill the space between shaft 20 and chamber 19, to allow the coupling member 12 to accommodate smaller sized shafts.

Furthermore, although coupling member 12 is connected to shaft 20 using a screw, other means to connect shaft 20 and coupling member 12 can be utilized such as, for example, corresponding screw threads on shaft 20 and bore 19.

While the preferred embodiment of the present invention has been described in connection with a lacrosse stick, the present invention can be used or modified to be used with any type of athletic equipment, such as, for example, any sport utilizing a stick, club, racket or bat.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention.

What is claimed is:

1. A lacrosse training aid for releasably attaching a free end of a shaft of a lacrosse stick without a netted head to a resistance source, comprising:

first and second coupling members rotationally connected together, for releasably attaching a free end of a shaft of a lacrosse stick without a netted head to a resistance source, said first coupling member being coupled to said resistance source and said second coupling member being releasably coupled to said free end of said shaft of said lacrosse stick, wherein said second coupling member has a lateral sidewall and a screw hole defined in said lateral sidewall, generally adjacent a first end of said second coupling member, and wherein said shaft of said lacrosse stick has an upper portion adjacent to said free end thereof and wherein at least a portion of said second coupling member adjacent to said first end thereof defines a bore therein having an inner closed end and an opposite second open end, such that said bore opens outwardly solely towards said first end of said second coupling member, said bore being configured and dimensioned for releasable receipt of said upper portion of said shaft of said lacrosse stick therein;

wherein one of said first and said second coupling members has a head portion having a lower surface and a generally cylindrically-shaped recessed male end portion extending outwardly from said lower surface of said head portion and the other of said first and said second coupling members has an upper surface having an outer peripheral edge, and an open-ended, generally cylindrically-shaped female bore defined therein which is spaced inwardly from said outer peripheral edge of said upper surface, said female bore being configured and dimensioned for 360° rotational receipt of said male end portion therein with said lower surface of said head portion abutting said upper surface of said other of said first and said second coupling members, to permit said first and said second coupling members to rotate 360° relative to each other about a longitudinally extending axis of rotation;

wherein when said upper portion of said shaft of said lacrosse stick is received within said bore, said free end of said shaft of said lacrosse stick is disposed generally adjacent to said inner closed end of said bore and is enclosed within said bore; and said training aid further comprises a screw, and wherein said upper portion of said shaft of said lacrosse stick has a lateral sidewall and a screw hole is defined in said lateral sidewall of said upper portion of said shaft, generally adjacent said free end, and wherein said screw extends through said screw hole in said lateral sidewall of said second coupling member and said screw hole in said lateral sidewall of said shaft of said lacrosse stick, to releasably couple said shaft of said lacrosse stick to said second coupling member.

2. The lacrosse training aid according to claim 1, wherein: said first coupling member is releasably coupled to said resistance source.

3. The lacrosse training aid according to claim 1, wherein: said lacrosse training aid is made of plastic.

4. The lacrosse training aid according to claim 1, wherein: said lacrosse training aid is made of aluminum.

5. The lacrosse training aid according to claim 1, wherein: said first coupling member comprises a closed loop, at least partially extending outwardly therefrom, for coupling said first coupling member to said resistance source.

6. The lacrosse training aid according to claim 1, wherein: a latitudinal cross-section of said bore is generally rectangular.

7. The lacrosse training aid according to claim 1, wherein: said first and said second coupling members each have a coaxially extending longitudinal axis and wherein said longitudinally extending axis of rotation is coaxially aligned with said longitudinal axes of said first and said second coupling members.

8. The lacrosse training aid according to claim 1, wherein: said resistance source comprises a cable having two opposite ends, wherein one end of said cable is connected to said first coupling member and said other end of said cable is connectable to at least one moveable weight.

9. The lacrosse training aid according to claim 1, wherein: said resistance source comprises an elastic resistance band having two opposite ends, wherein one end of said resistance band is connected to said first coupling member and said other end of said cable is connectable to a stationary object.

10. The lacrosse training aid according to claim 1, wherein: said outwardly-opening bore and said lateral sidewall of said second coupling member each have a diameter which is greater than the diameter of the shaft of the lacrosse stick.

11. The lacrosse training aid according to claim 1, wherein: said lower surface of said head portion has an outer peripheral edge which is aligned with said outer peripheral edge of said upper surface of said other coupling member.

12. The lacrosse training aid according to claim 1, further comprising:

an eyebolt;

and wherein said first and second coupling members define a generally centrally disposed longitudinally extending second bore, for receipt of said eyebolt therein.

13. The lacrosse training aid according to claim 1, wherein: said first and second coupling members each define generally centrally disposed, coaxially extending longitudinal bores therein, for receipt of said means for rotationally coupling.

14. A lacrosse training aid kit, comprising:

a shaft of a lacrosse stick without a netted head having a free end and an upper portion adjacent to said free end thereof, wherein said upper portion of said shaft has a lateral sidewall and a screw hole is defined in said lateral sidewall of said upper portion of said shaft, generally adjacent to said free end;

a lacrosse training aid comprising at least one coupling member for releasably attaching said free end of said shaft of said lacrosse stick to a resistance source, said at least one coupling member having two opposite ends, a first end releasably coupled to said free end of said shaft of said lacrosse stick and a second end coupled to said resistance source, wherein said at least one coupling member has a lateral sidewall and a screw hole defined in said lateral sidewall, generally adjacent to said first end of said at least one coupling member, and wherein at least a portion of said at least one coupling member adjacent to said first end thereof defines a bore therein having an inner closed end and an opposite second open end, such that said bore opens outwardly solely towards said first end of said at least one coupling member, said bore being configured and dimensioned for releasable receipt of said upper portion of said shaft of said lacrosse stick therein;

wherein said upper portion of said shaft of said lacrosse stick is received within said bore, with said free end of said shaft of said lacrosse stick disposed generally adjacent to said inner closed end of said bore and is enclosed within said bore;

said training aid further comprises a screw, and wherein said screw extends through said screw hole in said lateral sidewall of said at least one coupling member and said screw hole in said lateral sidewall of said shaft of said lacrosse stick, to releasably couple said shaft of said lacrosse stick to said at least one coupling member; and a resistance source coupled to said second end of said at least one coupling member, said resistance source comprising a member selected from the group consisting of an elastic resistance band having two opposite ends, wherein one end of said resistance band is connected to said second end of said at least one coupling member and said other end of said cable is connectable to a stationary object, and a cable having two opposite ends, wherein one end of said cable is connected to said second end of said at least one coupling member and said other end of said cable is connected to at least one moveable weight.

15. The lacrosse training aid kit according to claim 14, wherein:

said outwardly-opening bore and said lateral sidewall of said at least one coupling member each have a diameter which is greater than the diameter of the shaft of the lacrosse stick.

16. A lacrosse training aid for releasably attaching a free end of a shaft of a lacrosse stick without a netted head to a resistance source, comprising:

a shaft of a lacrosse stick without a netted head having a free end and an upper portion adjacent to said free end thereof, wherein said upper portion of said shaft has a lateral sidewall having a polygonal latitudinal cross-section and a screw hole defined in said lateral sidewall of said upper portion of said shaft, generally adjacent to said free end;

a lacrosse training aid comprising at least one coupling member for releasably attaching said free end of said shaft of said lacrosse stick to a resistance source, said at least one coupling member having two opposite ends, a first end releasably coupled to said free end of said shaft of said lacrosse stick and a second end coupled to said resistance source;

wherein said at least one coupling member has a lateral sidewall and a screw hole defined in said lateral sidewall, generally adjacent to said first end of said at least one coupling member, and wherein at least a portion of said at least one coupling member adjacent to said first end thereof defines a bore therein having an inner closed end and an opposite second open end, such that said bore opens outwardly solely towards said first end of said at least one coupling member, said bore being configured and dimensioned for releasable receipt of said upper portion of said shaft of said lacrosse stick therein;

wherein said upper portion of said shaft of said lacrosse stick is received within said bore, with said free end of said shaft of said lacrosse stick disposed generally adjacent to said inner closed end of said bore and is enclosed within said bore; and a screw, and wherein said screw extends through said screw hole in said lateral sidewall of said at least one coupling member and said screw hole in said lateral sidewall of said shaft of said lacrosse stick, to releasably couple said shaft of said lacrosse stick to said at least one coupling member.

17. The training aid according to claim 16, wherein:

said at least one coupling member comprises a first coupling member which is connected to said resistance source and a second coupling member which is connected to said free end of said shaft of said lacrosse stick.

18. The training aid according to claim 17, wherein:

said first coupling member and said second coupling member are rotationally connected to each other in a manner which permits said first and said second coupling members to rotate 360° relative to each other about an axis of rotation.

* * * * *